US005267004A

United States Patent [19]

Mills

[11] Patent Number: 5,267,004

[45] Date of Patent: Nov. 30, 1993

[54] ROTATING WICK FOR FUSING APPARATUS HAVING IMPROVED OIL LAYDOWN

[75] Inventor: Borden H. Mills, Webster, N.Y.

[73] Assignee: Eastman Kodak Company, Rochester, N.Y.

[21] Appl. No.: 809,988

[22] Filed: Dec. 18, 1991

[51] Int. Cl.[5] ..... G03G 15/20; G03G 21/00

[52] U.S. Cl. ..... 355/284; 118/258; 118/264; 355/282

[58] Field of Search ..... 355/284, 282, 293, 295; 118/60, 256, 258, 262, 264, 266, 268

[56] References Cited

U.S. PATENT DOCUMENTS

| | | | |
|---|---|---|---|
| 3,718,116 | 2/1973 | Thettu | 118/264 X |
| 3,831,553 | 8/1974 | Thettu | 118/266 |
| 3,943,540 | 3/1976 | Vanderheyden | 118/260 |
| 3,964,431 | 6/1976 | Namiki | 118/60 |
| 4,083,322 | 4/1978 | Beckman, Jr. | 118/60 X |
| 4,309,957 | 1/1982 | Swift | 118/60 |
| 4,426,953 | 1/1984 | Kromm, Jr. et al. | 118/60 |
| 4,429,990 | 2/1984 | Tamary | 355/284 |
| 4,593,992 | 6/1986 | Yoshinaga et al. | 355/284 |
| 4,751,548 | 6/1988 | Lawson | 118/268 X |
| 4,777,903 | 10/1988 | Wilcox | 355/284 |
| 4,908,670 | 3/1990 | Ndebi | 355/284 |
| 4,920,382 | 4/1990 | Mills et al. | 355/284 |
| 4,942,433 | 7/1990 | Stuart | 355/284 |
| 5,043,768 | 8/1991 | Baruch | 355/284 |

*Primary Examiner*—R. L. Moses
*Assistant Examiner*—Shuk Y. Lee
*Attorney, Agent, or Firm*—Leonard W. Treash, Jr.

[57] ABSTRACT

A rotating wick for a fuser includes an outside surface having a roughness less than 0.1 mm. peak-to-valley. The outside surface is preferably a porous fibrous cloth which can cover a NOMEX needled felt surrounding a rotatable porous ceramic material. If enough turns of the cloth are used, the felt can be eliminated and single convolutions of the cloth can be severed and thrown away when soiled.

4 Claims, 2 Drawing Sheets

ROTATING WICK FOR FUSING APPARATUS HAVING IMPROVED OIL LAYDOWN

TECHNICAL FIELD

This invention relates to apparatus for fusing toner images carried on a receiving sheet. More particularly, it relates to a rotating wick oiling device for applying offset preventing liquid to a surface in such a fuser.

BACKGROUND ART

U.S. Pat. No. 4,429,990, granted to E. J. Tamary, on Feb. 7, 1984, discloses a wicking structure for applying release liquid to a surface of a roller in a roller fixing apparatus. Release liquid, commonly referred to as "oil" is transported under pressure from a container to a permanent internal feed tube located inside a replaceable rotatable porous applicating wick. The wick constitutes a wicking or application roller which, when in contact with a fixing roller, is rotated by the fixing roller while it "oils" the surface. The structure has many advantages, including low cost, ease in articulation, and low wear on the fixing roller's surface. It also can be used on fixing belts or other moving surfaces.

The structure shown in that patent is commonly called a "rotating wick" and has been adopted commercially in a number of copiers and printers. The feed tube is cylindrical and has small holes laser drilled or punched along its elongated sidewalls through which liquid can pass. The wick is installed or pulled over the free end of the feed tube. The replaceable wick rotates either with respect to the feed tube or with the feed tube. It is a porous structure which includes an inner ceramic porous material that is covered by a porous and heat resistant fabric such as wool, or a comparable synthetic fabric. Such a synthetic fabric is marketed by DuPont under the trademark NOMEX (poly-(m-phenyleneisophthalamide)) and is a well-known capillary fabric which is resistant to heat and used for a variety of fusing system wicks. See also, U.S. Pat. No. 4,908,670 to Ndebi, issued Mar. 13, 1990; and U.S. Pat. No. 3,964,431 to Namiki, issued Jun., 1976.

The wool, NOMEX or other fabric wraps on virtually all prior commercial rotating wicks have worked well for many applications. However, for some applications, the fabric rolling with the fusing roller leaves a pattern defined by the fabric in the oil coating of the fusing roller. This can cause a pattern on the receiving sheet which is especially noticeable in transparencies. Low areas of oil can also cause insufficient release causing a pick-up of toner by the fusing roller. This, of course, disturbs the toner, the toned image on the sheet and in time causes wear to the fusing roller.

U.S. Pat. No. 5,043,768 issued Aug. 27, 1991 to S. C. Baruch; U.S. Pat. No. 4,942,433 to Stuart, issued Jul. 17, 1990, and U.S. Pat. No. 4,920,382 to Mills et al issued Apr. 24, 1990, discuss this problem at length and suggest solutions which are effective in certain environments.

The following references show stationary wicks having a needled wicking material such as NOMEX which spreads oil on a rotating roller. In some instances, the stationary NOMEX wick is covered by a porous Teflon to allow it to slide easier on the roller: U.S. Pat. No. 3,943,540, Vanderheyden, issued Mar. 9, 1976; U.S. Pat. No. 4,777,903, Wilcox, issued Oct. 18, 1988, U.S. Pat. No. 4,309,957, Swift, issued Jan. 12, 1982, U.S. Pat. No. 3,831,553, Thettu, issued Aug. 27, 1974, U.S. Pat. No. 4,426,953, Kromm, Jr. et al., issued Jan. 24, 1984, and U.S. Pat. No. 4,593,992, Yoshinaga et al, issued Jun. 10, 1986.

DISCLOSURE OF THE INVENTION

It is an object of the invention to reduce the localized irregularities in the laydown of oil on a surface in a fuser using a rotating wick oiler of this general type.

This and other objects are accomplished by a fuser for fusing toner images to a receiving sheet, which fuser has a moving surface to which oil is to be applied. A rotating wick for applying oil to the surface includes means for supplying oil, means for distributing the oil generally radially away from the supply means, a wicking material wrapped around the distributing means and a smooth surface porous material outside of the wicking material and engageable with said moving surface.

According to a preferred embodiment, the smooth surface porous material is a nylon, woven Nomex cloth and/or polyester/Nomex fibrous web which fully covers the NOMEX or wool wicking fiber normally forming the exterior of the rotating wick.

According to another preferred embodiment of the invention, the entire wicking material is replaced by a porous cloth which is wrapped a substantial number of times around the ceramic core. A portion of the cloth can be removed periodically to present a fresh oiling surface to the surface being oiled.

BEST MODES OF CARRYING OUT THE INVENTION

Figure 1:
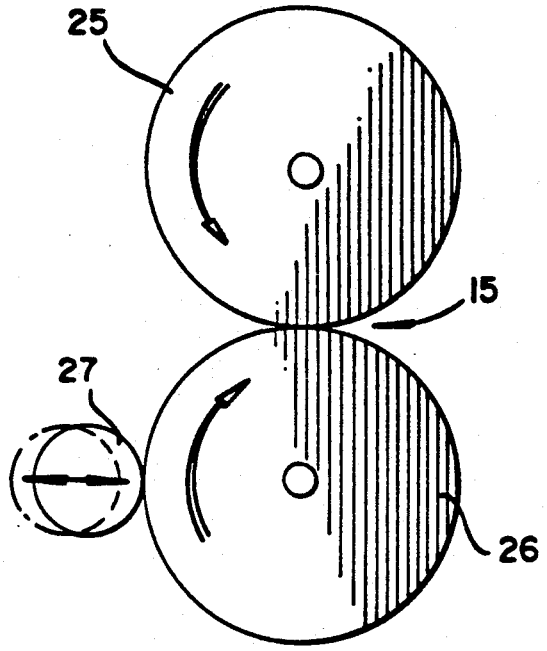
Fig. 1 PRIOR ART
FIG. 1 is a side schematic of a roller fuser of the type in which the invention is particularly usable.

FIG. 1 shows a roller fuser made up of a fusing roller 26 and a pressure roller 25 forming a nip 15 into which a receiving sheet is fed. The receiving sheet has a loose toner image facing downward which contacts fusing roller 26. One or both rollers is internally or externally heated, and one or both rollers is somewhat compliant to form a nip of reasonable size to both heat the toner and apply pressure to it to fix the image to the receiving sheet, all as is well known in the art. To prevent offset of toner onto the fusing roller 26, a thin layer of oil is applied by a rotating wick 27 which is articulatable in and out of contact with the surface of fusing roller 26. A similar rotating wick can be used to apply a small coating of oil to pressure roller 25. The same mechanism can be used to apply fusing oil to a fusing belt, ferrotyping plate or the like providing it continuously moves relative to the wick during the oil applying process so that it rotates the wick.

Figure 2:
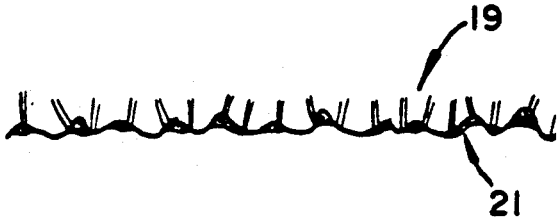
Fig. 2 PRIOR ART
FIGS. 2 and 3 illustrate a rough surfaced oiling wick and the laydown of oil from it, respectively.
Figure 3:
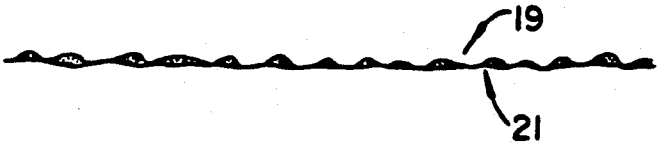
Fig. 3 PRIOR ART

Prior art wicks in present use have universally had an outer layer of NOMEX or wool which directly contacts the fusing surface. As shown in FIG. 2, a NOMEX wick presents an irregular surface which collects oil somewhat irregularly at the base of the pores or needling holes. This causes a laydown of oil, shown in FIG. 3, of a somewhat uneven, perhaps patterned, character. This oil, when applied to high quality color images, especially on transparency stock, leaves a pattern that ends up being visible when the transparency image is projected.

Figure 4:
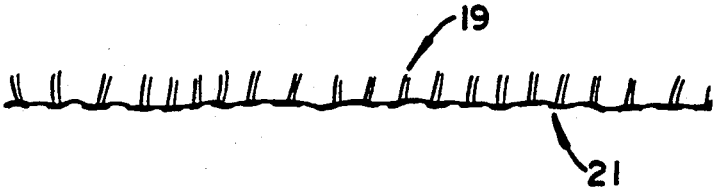
FIGS. 4 and 5 illustrate a smooth surface wick and the laydown of oil from it, respectively.
Figure 5:
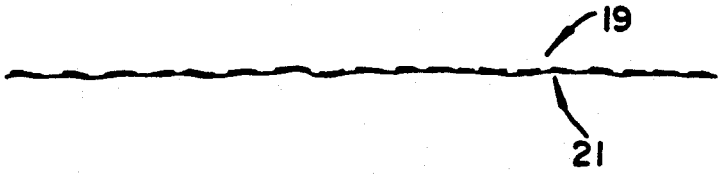

This problem is well documented in prior patent applications noted above. To solve this problem, a smooth outer wick surface shown in FIG. 4 is used, which may still have the pores or needling holes visible above its surface. The resulting oil laydown is shown in FIG. 5 which is considerably less patterned and provides better color transparencies for projection.

It has also been found that with the smooth surface wick there is less likely to be local areas of excess oil on paper stock (as well as transparency stock). This can be especially significant if the excess oil is applied to the first side of duplex copy which copy is ultimately to be fed back through the system to pick up a toner image on its opposite side which must also be fused. In such systems, oil can contaminate a transfer drum or other elements it touches and ultimately find its way to a photoconductor or other image member with image degrading effects.

Figure 6:
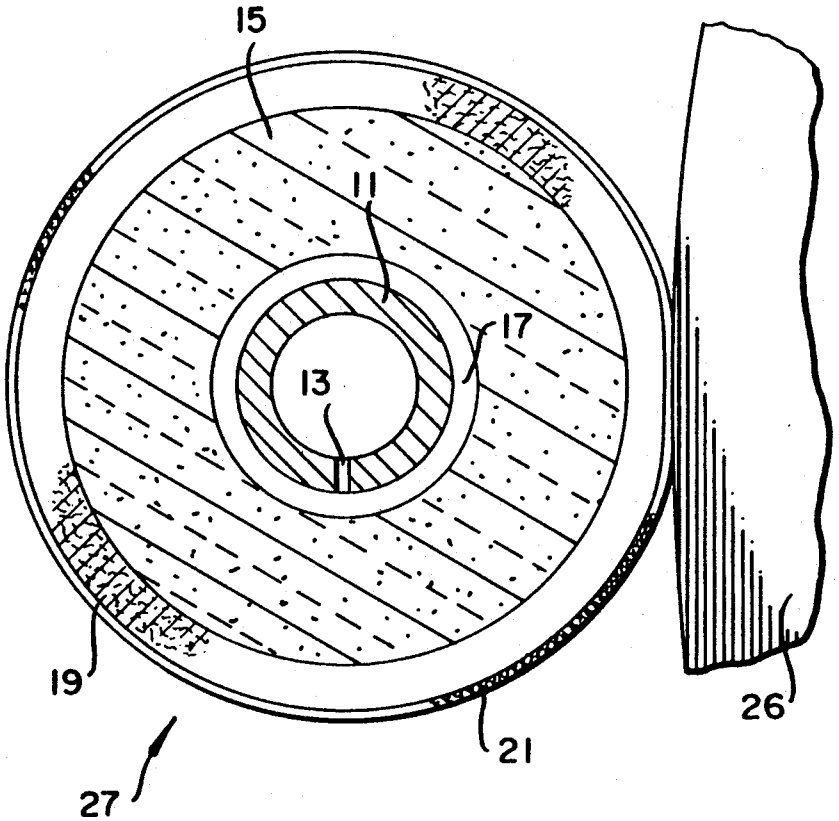

FIG. 6 illustrates an embodiment of the invention, in which rotating wick 27 includes a stationary distribution tube 11 having distribution holes 13 through which oil is pumped. Very closely air spaced from the distribution tube 11 is a rotatable porous ceramic member 15 which is used in present wicks, except that it is more closely spaced from distribution tube 11 than conventional. This closely spaced construction greatly reduces the effect of any puddling in the air space 17 between the distribution tube 11 and ceramic 15.

Around the outside of rotatable porous ceramic material 15 is a wool or NOMEX wrap 19 that is also conventional. To prevent laydown of oil comparable to that shown in FIG. 3, the wicking material 19 is covered with a cloth 21 which forms the smooth surface shown in FIG. 4 and provides the laydown shown in FIG. 5.

The cloth 21 is preferably a woven nylon but could also be a woven NOMEX, a NOMEX/polyester fibrous web, or the like. Preferably, the web provides a surface that does not vary from peak-to-valley by more than 0.1 mm, has a large density of small pores or holes, and is resistant to the temperature of the surface oiled.

Figure 7:
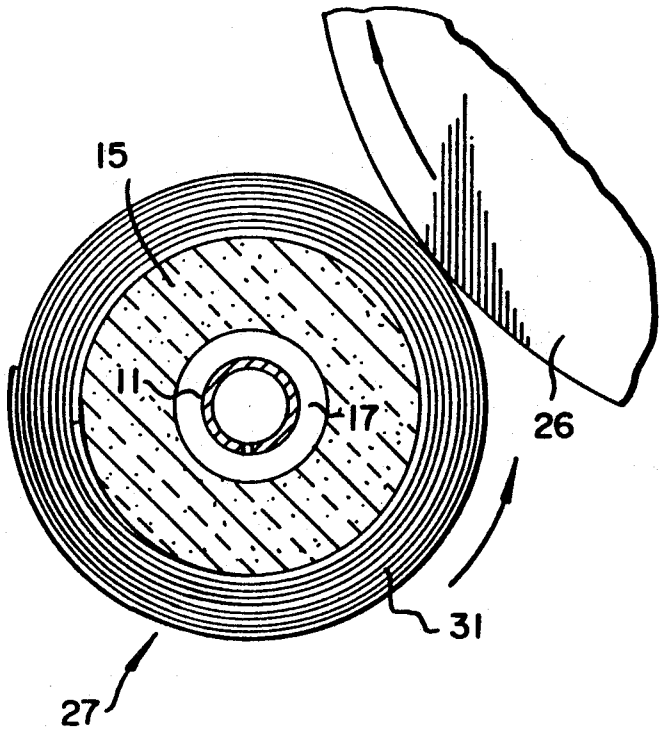
FIGS. 6 and 7 illustrate cross-sections of preferred fusing wicks constructed according to alternative preferred embodiments of the invention.

FIG. 7 shows an alternative of the invention in which the needled wicking material 19 in FIG. 6 is eliminated altogether and a long porous web 31 is wrapped directly on the porous ceramic 15. Sufficient wraps of the porous material are made to properly spread and distribute the oil as is done by the wicking substance 19 in FIG. 6. This embodiment facilitates an additional feature. More specifically, all wicks become contaminated by toner and paper residue over time. This contamination impedes oil flow and is the primary reason for replacement of the wick. The wick can be mounted on the fuser as shown so that the wrap does not unwind during operation. When the surface layer becomes contaminated, it can be removed by cutting or tearing at strategically positioned perforations thereby exposing a clean surface to the fusing roller.

The invention has been described in detail with particular reference to a preferred embodiment thereof, but it will be understood that variations and modifications can be effected within the spirit and scope of the invention as described hereinabove and as defined in the appended claims.

We claim:

1. A fuser for fusing toner images to a receiving sheet, said fuser including a member having a moving surface to which oil is to be applied, and a rotating wick for applying oil to said surface, said rotating wick including:

means for supplying oil, rotatable means for distributing said oil generally radially away from said means for supplying oil, and a smooth surface porous material having a high density of small pores outside of and rotatable with said distributing means and engageable with and rotatable by said moving surface, said smooth surface porous material having a peak-to-valley roughness of less than 0.1 mm.

2. A fuser according to claim 1 wherein said means for distributing said oil is a porous ceramic material covered by a needled felt and said smooth surface porous material is a porous woven cloth covering said felt.

3. A fuser according to claim 2 wherein said porous ceramic material is very slightly air-spaced from said means for supplying oil.

4. A fuser according to claim 2 wherein said needled felt and said woven cloth are formed into a single porous web wrapped about the porous ceramic material in sufficient convolutions to permit removing a convolution when soiled without destroying its oil passing and distributing properties.

* * * * *